US012757987B2

(12) United States Patent
Muldowney, Jr.

(10) Patent No.: US 12,757,987 B2
(45) Date of Patent: Oct. 13, 2026

(54) WALLET BADGE HOLDER

(71) Applicant: Paul Muldowney, Jr., Warren, NJ (US)

(72) Inventor: Paul Muldowney, Jr., Warren, NJ (US)

( * ) Notice: Subject to any disclaimer, the term of this patent is extended or adjusted under 35 U.S.C. 154(b) by 1025 days.

(21) Appl. No.: 16/425,815

(22) Filed: May 29, 2019

(65) Prior Publication Data

US 2019/0380458 A1 Dec. 19, 2019

Related U.S. Application Data

(60) Provisional application No. 62/677,325, filed on May 29, 2018.

(51) Int. Cl.
*A45C 1/06* (2006.01)
*A45F 5/00* (2006.01)
*A45F 5/02* (2006.01)

(52) U.S. Cl.
CPC ..... *A45C 1/06* (2013.01); *A45F 5/021* (2013.01); *A45C 2001/062* (2013.01); *A45C 2001/067* (2013.01); *A45F 2005/006* (2013.01)

(58) Field of Classification Search
CPC ..... A45C 1/06; A45C 2001/062; A45C 2001/067; A45F 5/021; A45F 2005/006
USPC ..... 150/137
See application file for complete search history.

(56) References Cited

U.S. PATENT DOCUMENTS 3,660,915 A * 5/1972 Davis ..... B42F 5/00 150/147
4,316,492 A 2/1982 Plough et al.
7,740,131 B2 6/2010 Marcello
9,854,901 B2 1/2018 Seuk
D831,349 S 10/2018 Deng
11,178,947 B2 * 11/2021 Tran ..... A45C 1/06
2004/0216825 A1 * 11/2004 Radochonski ..... A45C 1/06 150/147
2013/0276943 A1 * 10/2013 Minn ..... A45C 1/06 150/137
2015/0257499 A1 * 9/2015 Muir ..... A45C 1/06 150/132
2015/0335113 A1 * 11/2015 Minn ..... A45C 13/1038 150/143
2016/0324283 A1 * 11/2016 Kane ..... A45C 11/182
2019/0008253 A1 * 1/2019 Deng ..... A45C 11/182

FOREIGN PATENT DOCUMENTS

CN 2549790 Y 5/2003

OTHER PUBLICATIONS

Print out of "The Ridge Wallet, Carbon Fiber," www.ridgewallet.com/collections/all-wallets/products/carbon-fiber (Undated).

* cited by examiner

*Primary Examiner* — Nathan J Jenness
*Assistant Examiner* — Jessica Kavini Tamil
(74) *Attorney, Agent, or Firm* — Budzyn IP Law, LLC

(57) ABSTRACT

A wallet badge holder is provided herein including: a first rigid plate having a recess formed therein shaped to accommodate a badge; a second rigid plate elastically displaceable relative to the first rigid plate to define a reversibly expandable and compressible chamber for receiving identification cards and credit cards; and, a cover removably mountable to the first rigid plate to selectively cover the recess. Advantageously, the subject invention provides for a compact and durable wallet badge holder.

3 Claims, 16 Drawing Sheets

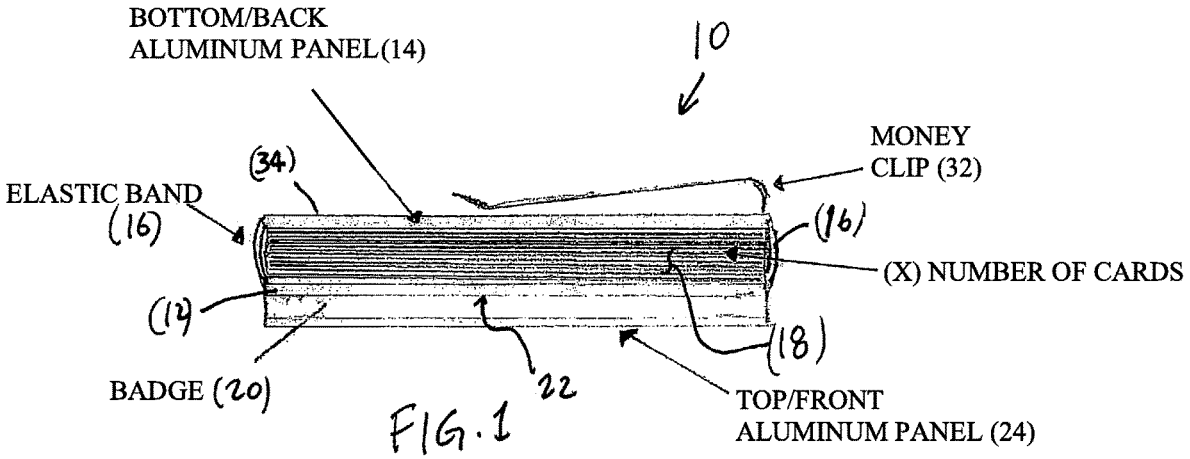
FIG. 1
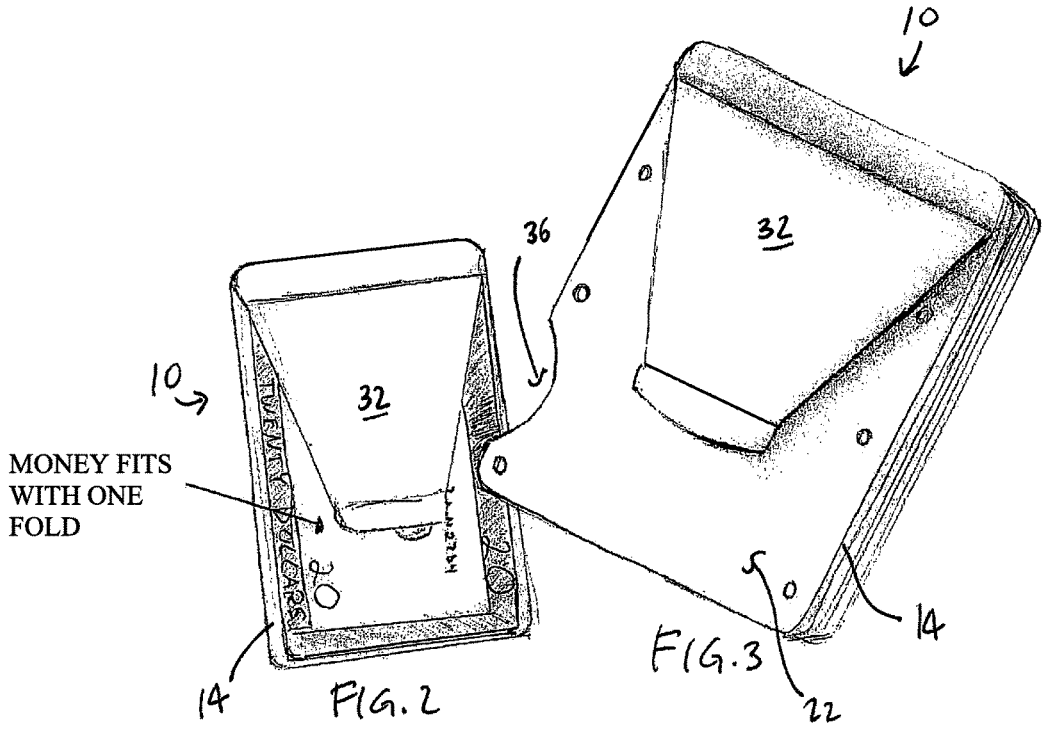
FIG. 2
FIG. 3

WALLET BADGE HOLDER

CROSS-REFERENCE TO RELATED APPLICATION

This application claims priority to U.S. Provisional Patent Appl. No. 62/677,325, filed May 29, 2018, the entire contents of which are incorporated by reference herein.

BACKGROUND

Many police officers use standard leather wallet police badge holders, which are typically large, heavy and cumbersome. Placement of a wallet police badge holder into one's back pocket may make it uncomfortable to sit and cause back pain over time. Also, the wallet may slip out of the back pocket easily during day to day activities. As a result of the discomfort of having the wallet police badge holder on the body, often, particularly when off duty, the wallet police badge holder is left in a car or held by someone, such as a spouse, boyfriend, girlfriend, etc. As a result, there may be no access to a police identification or badge if needed.

Credit card holders are known which are slim and fashionable. Present designs are limited to holding credit cards, and similarly shaped articles, and cash if a money clip is also provided.

SUMMARY OF THE INVENTION

A wallet badge holder is proposed herein which is a multifunctional money, card and badge holder. It can be constructed from aluminum, carbon fiber, polycarbonate, titanium or zinc, depending on construction/manufacturing costs. The wallet badge holder presents a card/badge holder for various law enforcement and emergency services, such as, police, fire and EMS personnel. The wallet badge holder may be comprised of a money/belt clip, credit card and badge holder. A badge mounted to the wallet badge holder may be protected by a removable cover panel that can be removed, slid or flipped. The removable cover panel may be connected by a hinge, pivot, and/or magnets. An expandable compartment may be provided for receiving cards and/or cash. The wallet badge holder may provide safety from electronic theft by utilizing two RFID blocking panels. A badge may be secured to the wallet badge holder by an adhesive such as, rubber cement or glue.

These and other features of the invention will be better understood through a study of the following detailed description and accompanying drawings.

BRIEF DESCRIPTION OF THE DRAWINGS

FIGS. 1-4 show a wallet badge holder formed in accordance with the subject invention;

DESCRIPTION OF THE INVENTION

With reference to the Figures, a wallet badge holder 10 is shown which generally includes first and second rigid plates 12, 14 with one or more connecting elastic bands 16. The first and second rigid plates 12, 14 are generally credit-card-shaped and define a chamber 18 therebetween for receiving credit cards, identification cards, and the like (in a stacked fashion). The first and second rigid plates 12, 14 may be generally rectangular, each with a length in the range of 89.3-90.0 mm and a width in the range of 66.6-70.0 mm. The elastic bands 16 are located on edges of the first and second rigid plates 12, 14 to urge the first and second rigid plates 12, 14 together, including in face-to-face contact. The elastic bands 16 provide a pulling force between the first and second rigid plates 12, 14 which causes pressure to be applied against any cards, cash, and the like received in the chamber 18 for retention, yet allows for expansion of the chamber 18, particularly with credit cards, cash and the like being deposited into the chamber 18. Accordingly, the chamber 18 is reversibly expandable and compressible.

Figures 22, 23, 24:
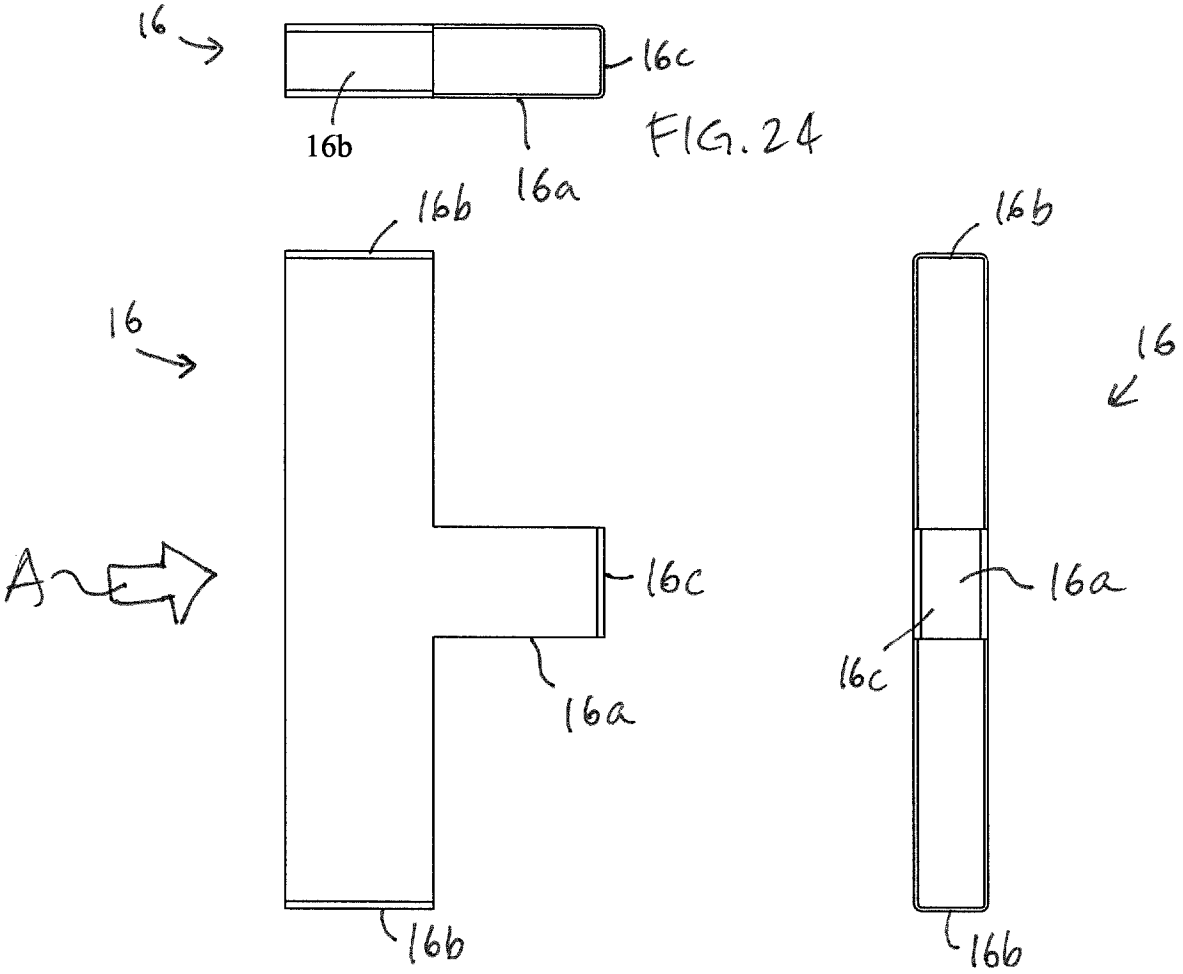
FIGS. 22-24 show an elastic band useable with the wallet badge holder shown in FIGS. 11-12.

A single elastic band 16 may be utilized. As shown in FIGS. 22-24, the elastic band 16 may be provided with a protruding pocket 16*a* to act as a side restraint to cards in the chamber 18. As shown in FIG. 22, arrow A shows direction of insertion of cards into the chamber 18 relative to the elastic band 16. Upper and lower portions of the band 16 not only provide elastic pulling force for the chamber 18, but also limit up and down movement of accommodated cards. The pocket 16*a* also provides a side retention to limit excessive insertion or passage of the cards through the chamber 18.

The first and second rigid plates 12, 14 may be formed of various metallic and/or polymeric materials, including, but not limited to, aluminum, carbon fiber, polycarbonate, titanium, zinc, tungsten, brass, copper, stainless steel, alloys, and acrylonitrile butadiene styrene (ABS) plastic. It is preferred that the first and second rigid plates 12, 14 be sufficiently robust to resist bending, particularly as a result of being carried in a user's pant pocket.

A badge 20 (police, fireman, EMS, etc.) is mounted to outer face 22 of the first rigid plate 12. Any technique for mounting may be utilized, including, but not limited to, adhesion, fusion, riveting, and/or welding. The badge 20 is preferably mounted to be securely retained to the outer face 22 under various conditions, including high-stress conditions.

Figure 16:
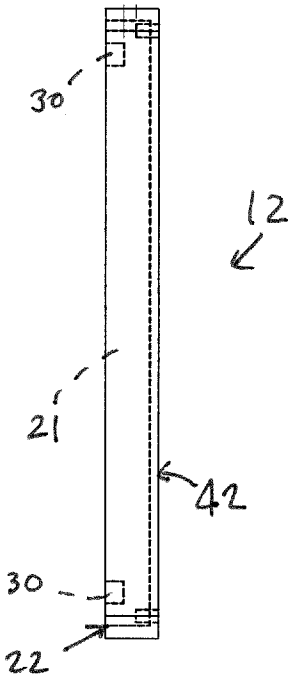
FIGS. 14-16 show a first rigid plate useable with the wallet badge holder shown in FIGS. 11-12.
Figure 15:
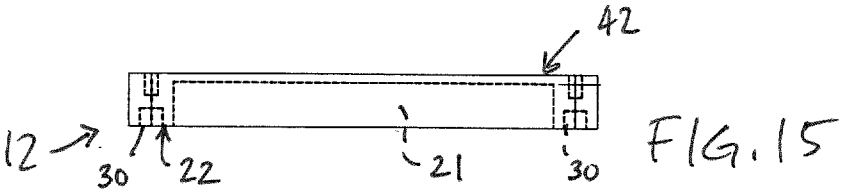
Figure 14:
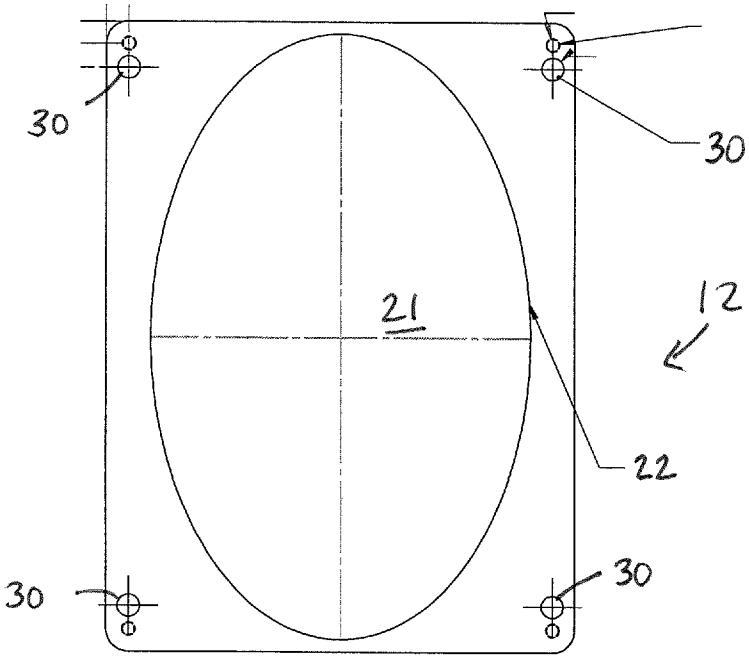
Figure 18:
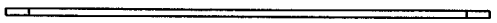
FIGS. 17-18 show a first cover plate useable with the wallet badge holder shown in FIGS. 11-12.

As shown in FIGS. 14-16, a recess 21 may be formed in the outer face 22 of the first rigid plate 12. The recess 21 may be formed to accommodate the badge 20 so that the badge 20 is recessed within the first rigid plate 12 while being mounted in the recess 21. It is preferred that no portion of the badge 20 protrude from the first rigid plate 12 when mounted in the recess 21.

The recess 21 may be shaped to match the profile of the badge 20. For example, as shown in FIG. 14, the recess 21 may have an oval shape to accommodate an oval-shaped badge. The recess 21 may be of any shape, e.g., shield-shaped, rectangular, etc., conforming to the shape of the badge 20. Customized shaping may be achieved by manufacturing the first rigid plate 12 in response to a customer's order. The first rigid plate 12 may be metallic with the recess 21 being milled or formed by other machining techniques. Alternatively, the first rigid plate 12 may be generated by three-dimensional printing techniques with the shape of the recess 21 being pre-programmed.

Figure 4:
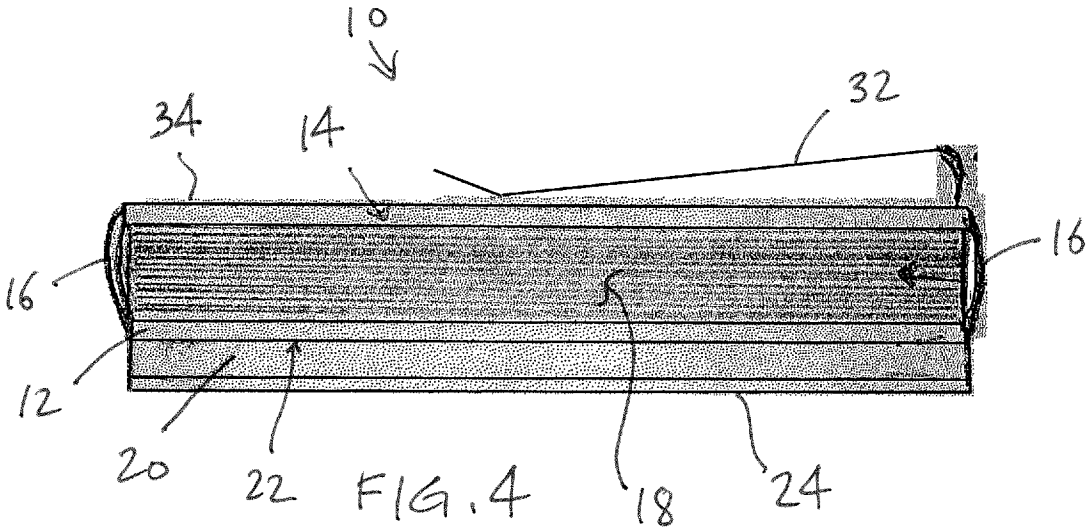
Figure 5:
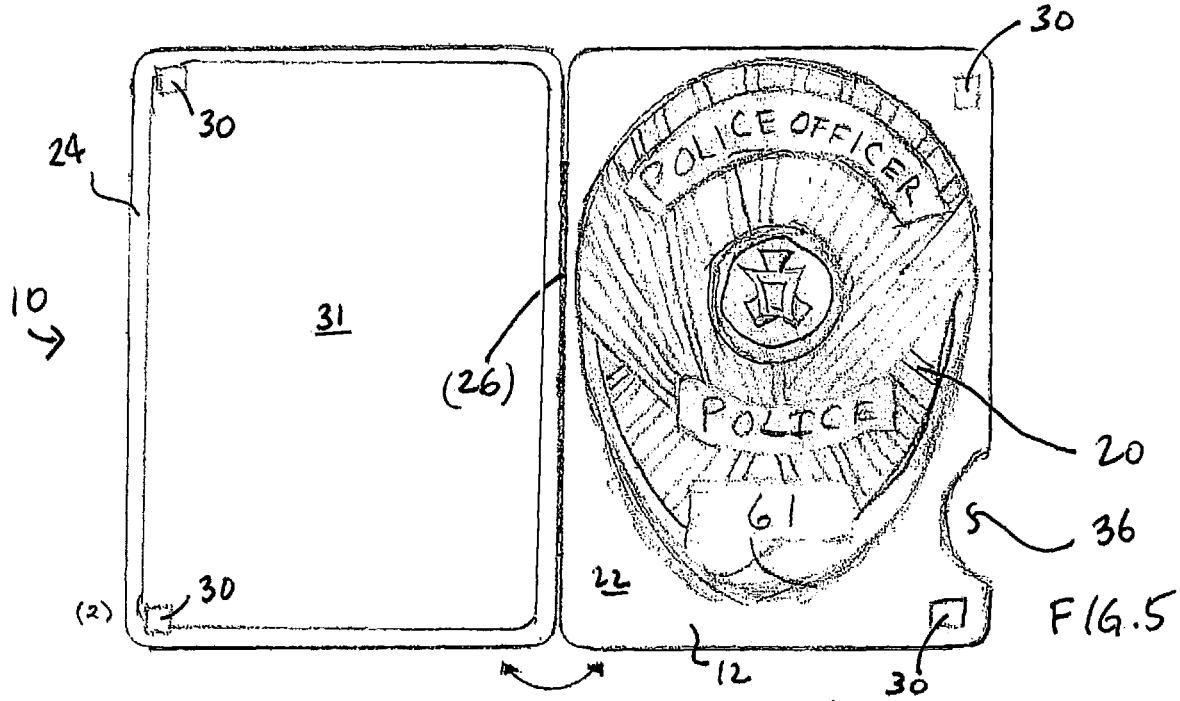
FIGS. 5-8 show different covers useable with the subject invention.
Figure 6:
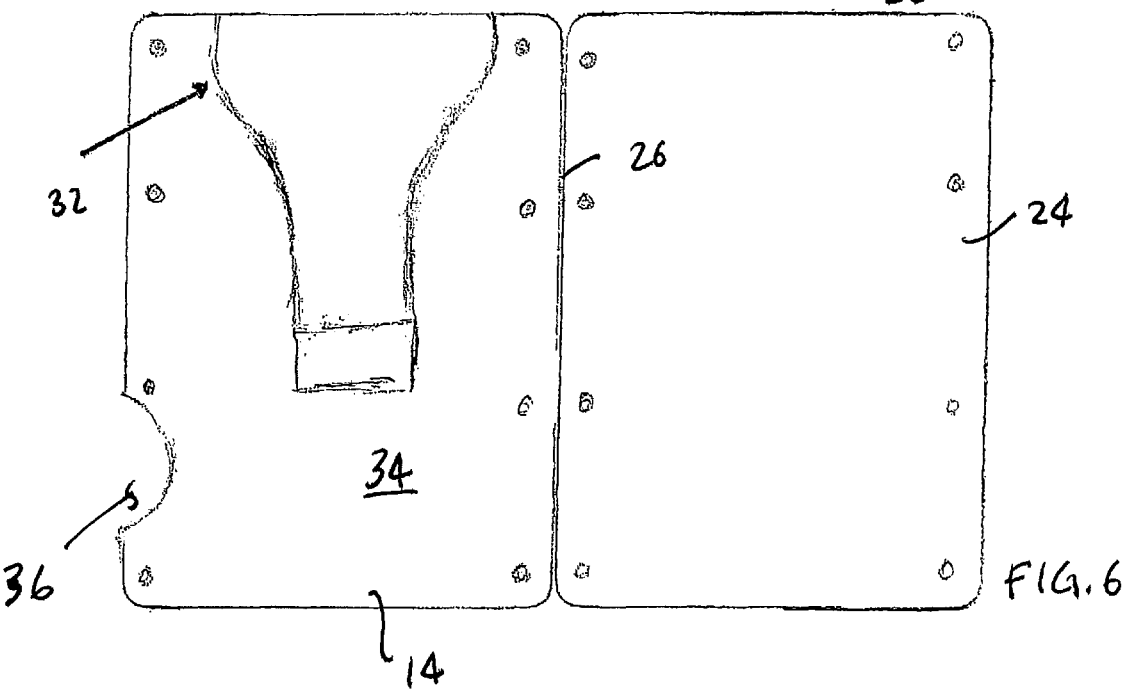
Figure 7:
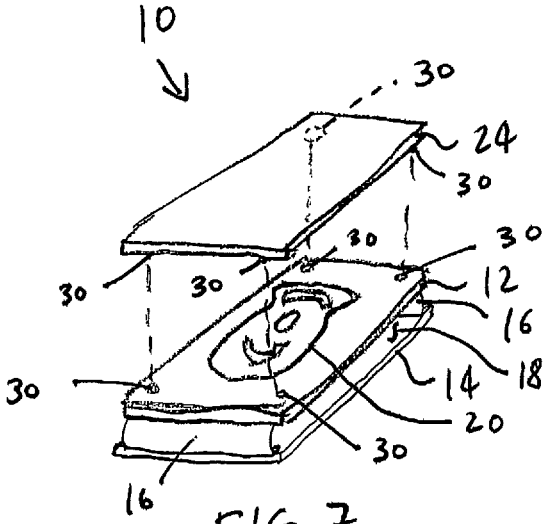
Figure 8:
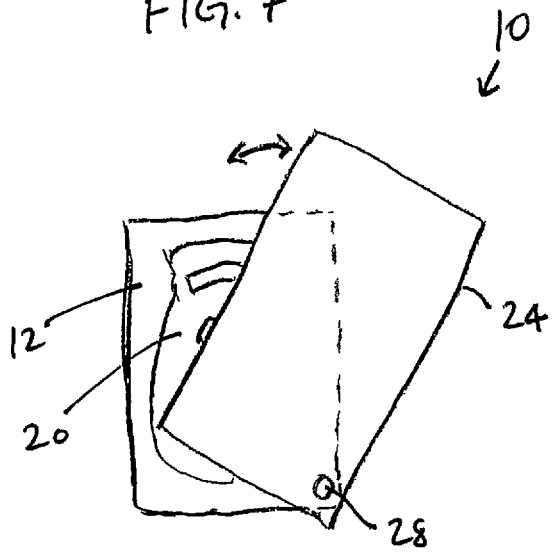

To conceal the badge 20, a cover 24 may be provided. The cover 24 may be formed of various metallic and/or polymeric materials, including, but not limited to, aluminum, carbon fiber, polycarbonate, titanium, zinc, tungsten, brass, copper, stainless steel, alloys, and acrylonitrile butadiene styrene (ABS) plastic. The cover 24 may be mounted to allow for selective coverage of the badge 20. As shown in FIGS. 5-6, the cover 24 may be hinge-mounted to the first rigid plate 12 with one or more hinges 26. The hinge 26 may be spring-loaded to urge towards a closed position of the cover 24. The cover 24 may be also removable from the first rigid plate 12, with a releasable holding arrangement being provided, such as magnets 30 (FIG. 7), spring clips, cooperating members, etc. The cover 24 may be also pin mounted to the first rigid cover plate 12 so as to be rotatable about pin 28, for example, as shown in FIG. 8. The magnets 30 may be provided for retaining the cover 24 in a closed position where the hinge 26 and/or the pin 28 is utilized.

The cover 24 may be formed transparent to allow for the badge 20 to be viewed with the cover 24 being over the badge 20. In this arrangement, the cover 24 may be permanently affixed to the first rigid plate 12 since removal or other adjustment is not required to the view the badge 20.

Figure 13:
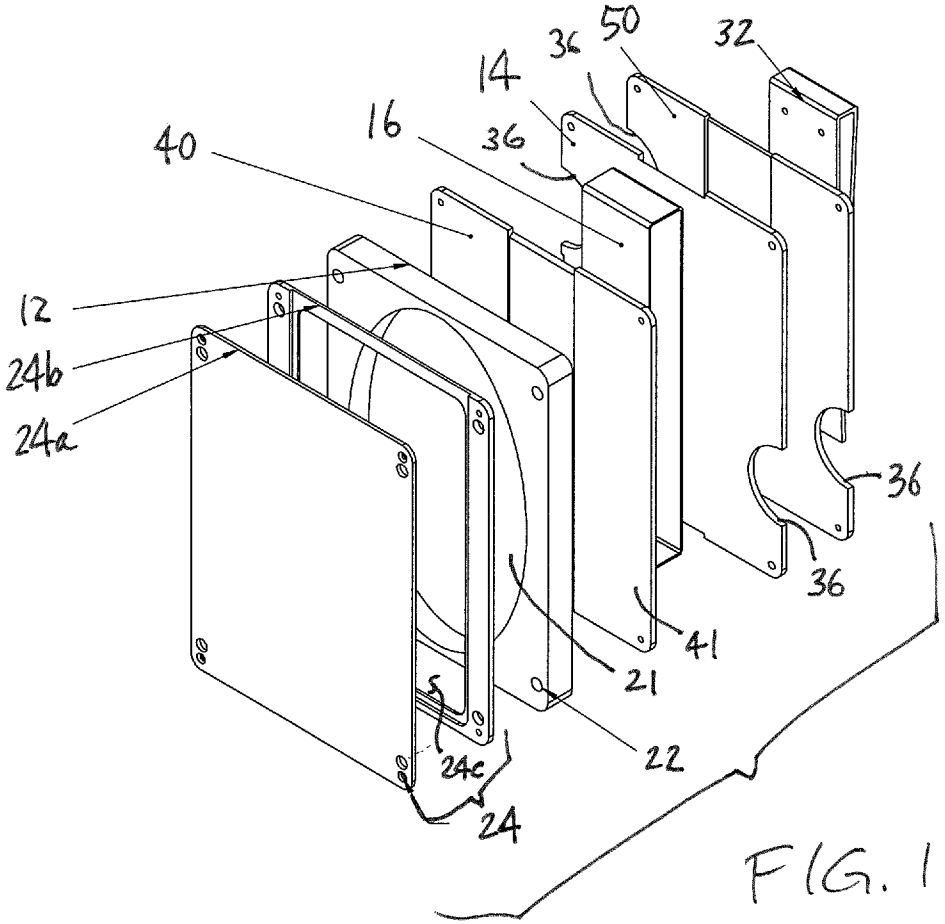
FIG. 13 is an exploded view of the wallet badge holder shown in FIGS. 11-12.
Figure 17:
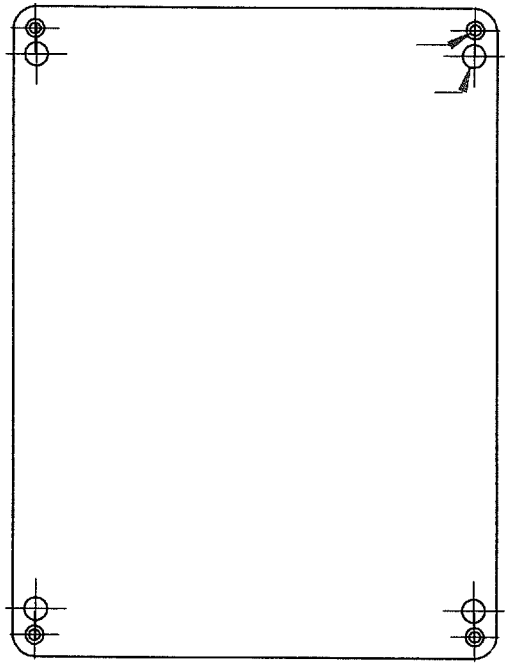
Figure 20:
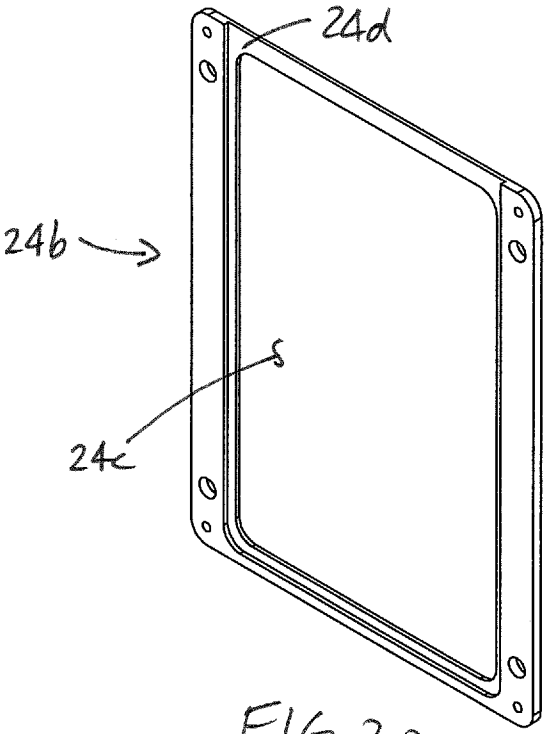
FIGS. 19-21 show a second cover plate useable with the wallet badge holder shown in FIGS. 11-12.
Figure 21:
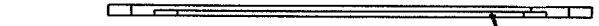
Figure 19:
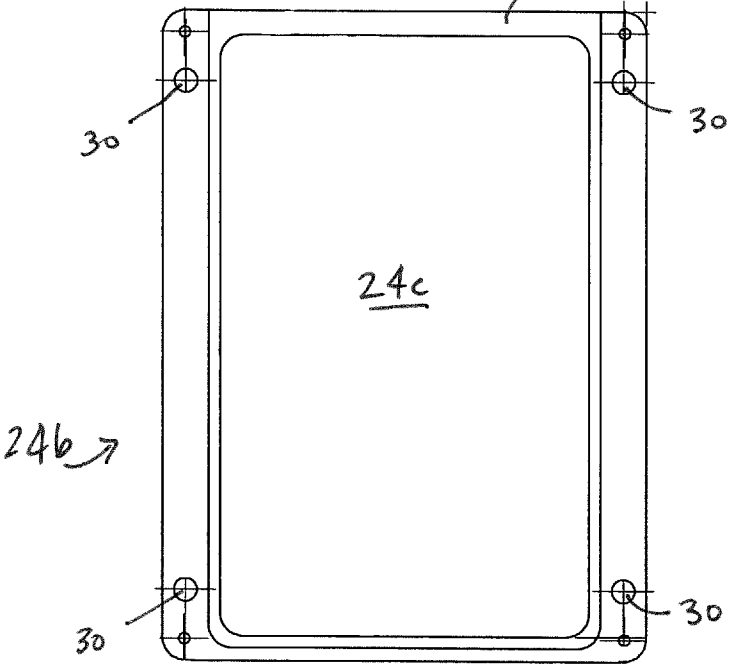

With reference to FIGS. 17-21, the cover 24 may be formed to be partially transparent, particularly to house an identification card or the like, in addition to covering the badge 20. As shown in FIG. 17, the cover 24 may include a first cover plate 24*a*, which may be opaque. As shown in FIGS. 19-21, the cover 24 may also include a second cover plate 24*b*, which may include a transparent window 24*c*. The transparent window 24*c* may be an opening or a pane of transparent material, such as glass or polymeric material (e.g., acrylic or vinyl). As shown in FIG. 13, the first and second cover plates 24*a*, 24*b* are mounted together face-to-face with the second cover plate 24*b* positioned to face the first rigid plate 12. A portion 24*d* of the second cover plate 24*b* may be recessed so as to define a gap 24*e* between the first and second cover plates 24*a*, 24*b*. The gap 24*e* is preferably configured to be larger in area than the transparent window 24*c* and to accommodate an identification card. With this arrangement, an identification card may be disposed in the gap 24*e* to be visible through the transparent window 24*c*, but with the edges of the identification card overlapped by portions of the second cover plate 24*b* which bound the transparent window 24*c*. The gap 24*a* may extend from open slot 24*f* which provides access into the gap 24*e* to insert or remove identification cards. With this arrangement, removal of the cover 24 allows for both exposing an identification card accommodated in the gap 24*e* and exposing the badge 20 mounted to the first rigid plate 12.

A protective pad 31, particularly of soft material (such as felt, elastomeric material, etc.), may line an inside of the cover 24 to act as a cushion between the cover 24 and the badge 20.

Figure 9:
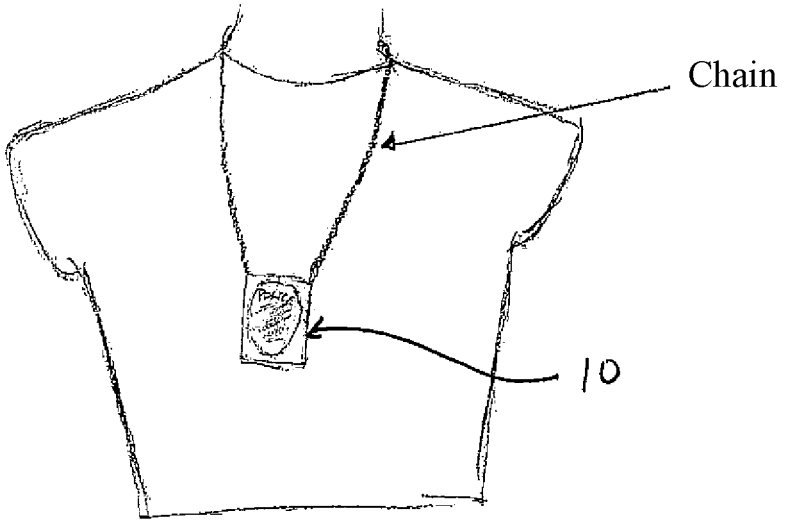
FIGS. 9-10 show a chain supported wallet badge holder in accordance with the subject invention.
Figure 10:
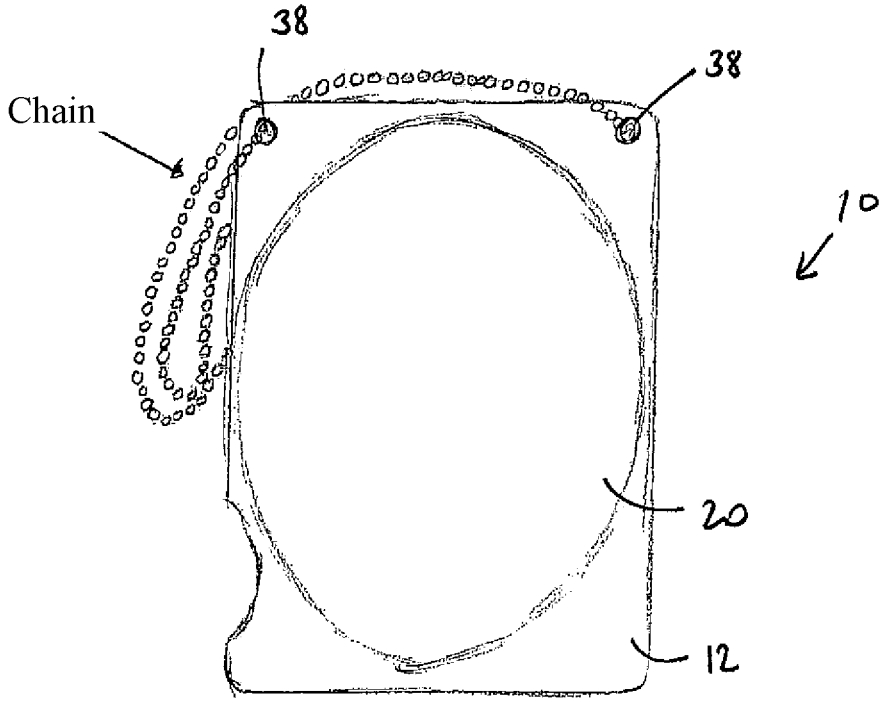

Additional components may be provided such as RFID blocking panels that may be secured to the first and second rigid plates 12, 14 to minimize RFID contact with any credit cards contained in the chamber 18. Also, a clip 32 may be provided on an outer face 34 of the second rigid plate 14. The clip 32 may serve as a money clip or as a belt clip allowing for the badge holder 10 to be carried in an exposed state. The clip 32 may be formed from various metallic materials, including, but not limited to, steel (e.g., string steel, stainless steel), carbon fiber, and aluminum. Finger cut-outs 36 may be defined in the first and second rigid plates 12, 14 to allow for easier contact with the edges of the credit cards and identification cards in the chamber 18. As shown in FIGS. 9 and 10, support holes 38 may be provided along an edge of the first and second rigid plates 12, 14, configured to allow a chain to pass through for allowing a user to suspend the badge holder 10 on a chain about their neck.

Figure 11:
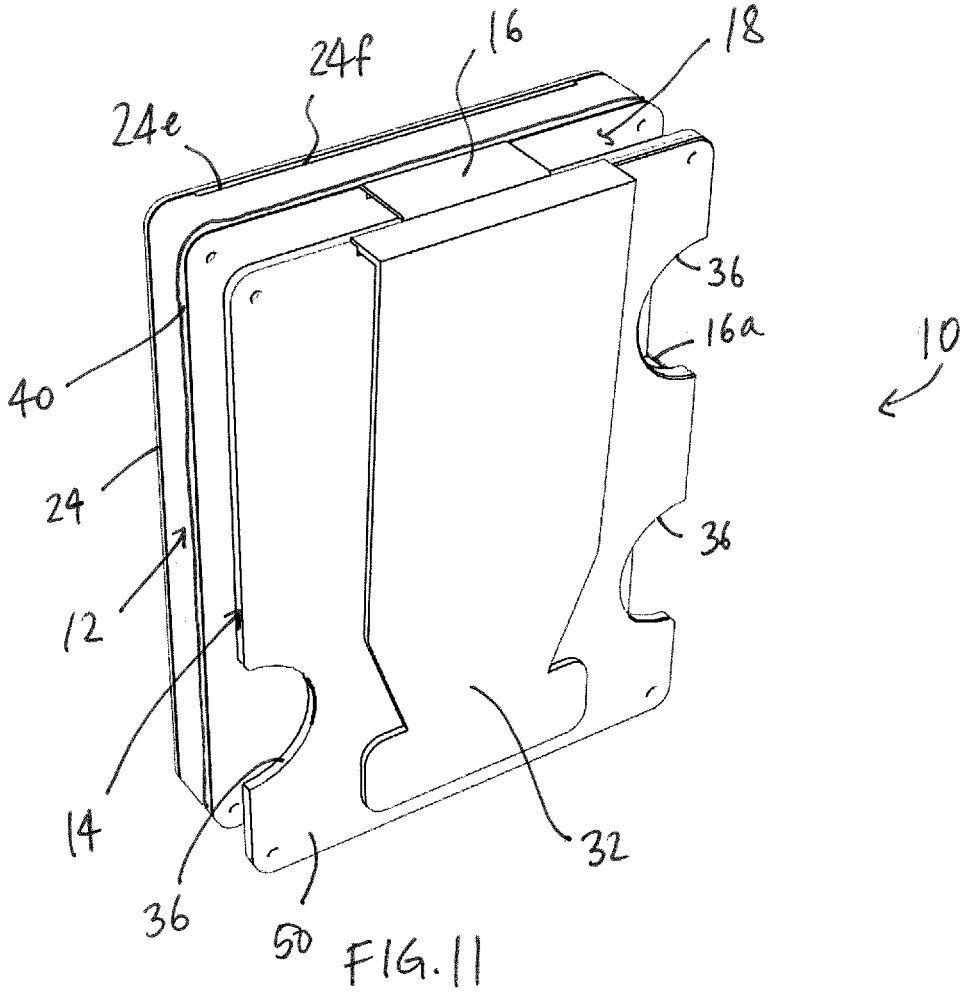
FIGS. 11-12 show a wallet badge holder in accordance with the subject invention.
Figure 12:
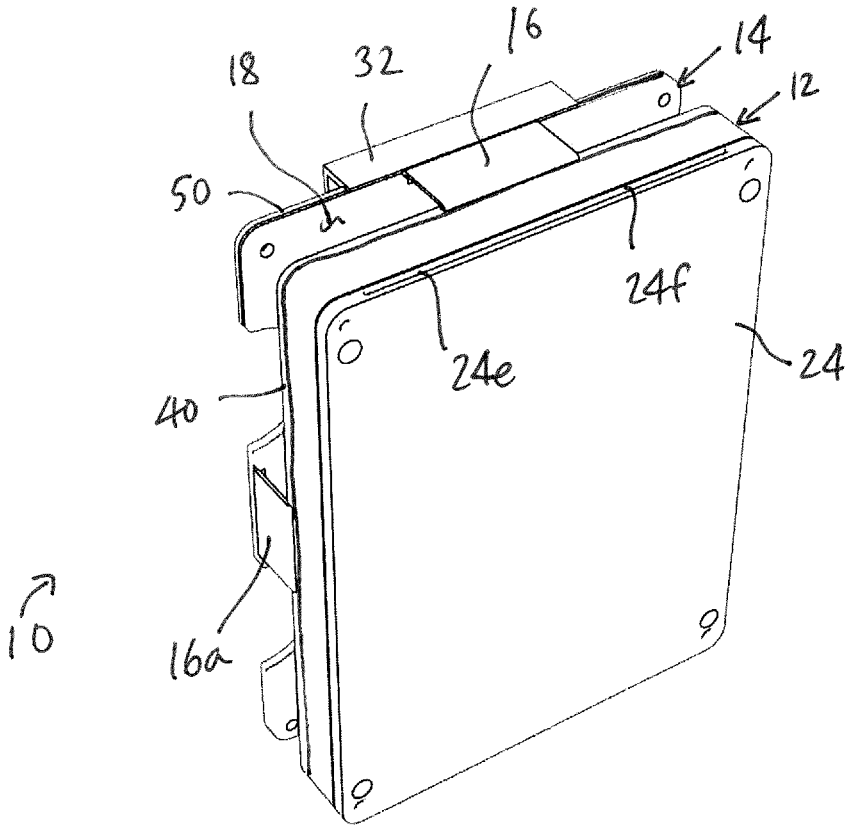
Figure 26:
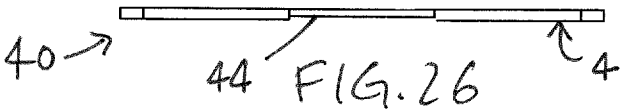
FIGS. 25-26 show an intermediate rigid plate useable with the wallet badge holder shown in FIGS. 11-12.
Figure 25:
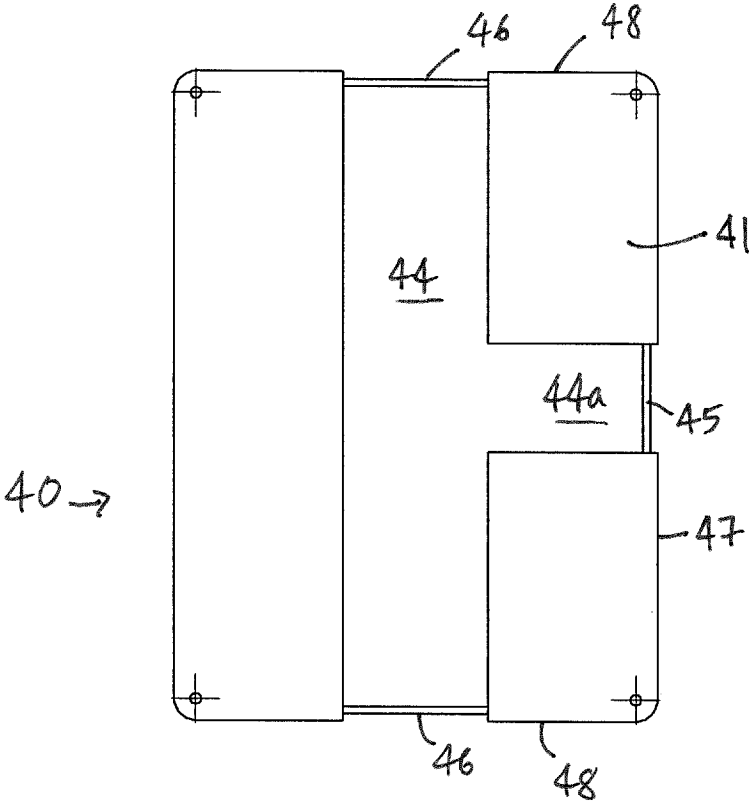

An embodiment of the badge holder 10 is shown in FIGS. 11-13. In this embodiment, as shown in FIG. 13, an intermediate rigid plate 40 may be provided for securement to the first rigid plate 12, particularly on an inner face 42, opposite the outer face 22. The elastic band 16 may pass between the first rigid plate 12 and the intermediate rigid plate 40 so as to be retained by the combination of the first rigid plate 12 and the intermediate rigid plate 40. As shown in FIGS. 25-26, a slot 44 may be defined on the back 41, opposite the chamber 18, of the intermediate rigid plate 40 formed to seat the elastic band 16 therewithin. Upper and lower edges 46 of the slot 44 may be off-set from the upper and lower edges 48 of the intermediate rigid plate 40 to provide clearance for the elastic band 16. The upper and lower edges 48 may be chamfered or rounded to avoid providing a sharp edge pressed against the elastic band 16. This avoids excessive wear of the elastic band 16.

Figures 27, 28:
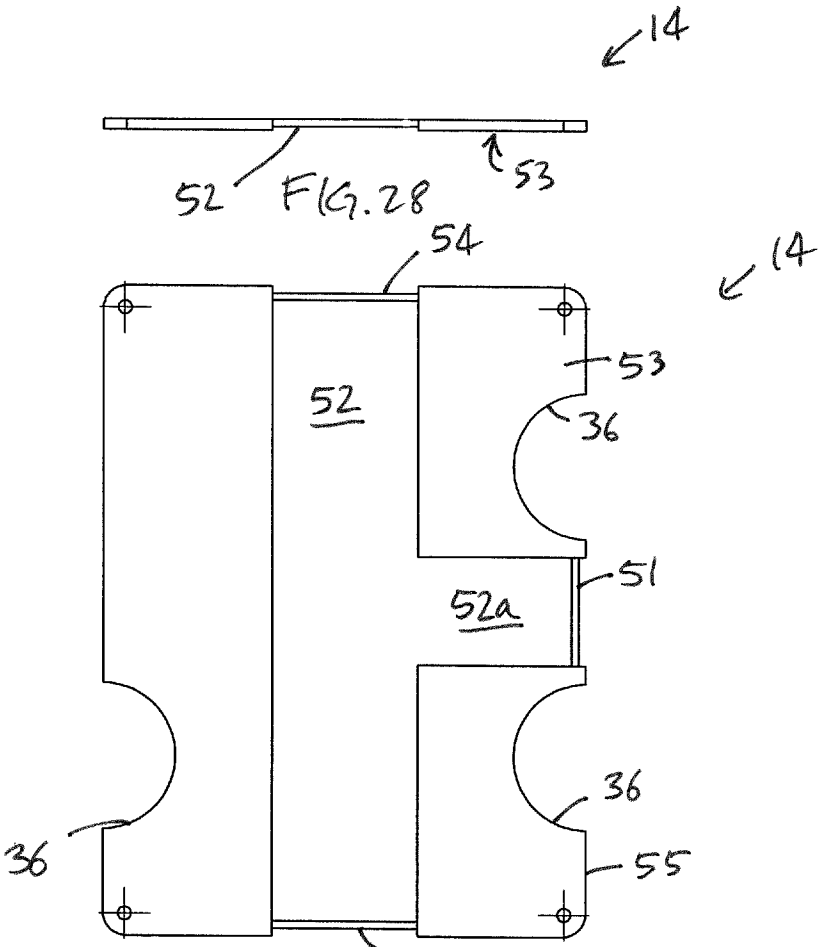
FIGS. 27-28 show a second rigid plate useable with the wallet badge holder shown in FIGS. 11-12.

As also shown in FIG. 13, an outer rigid plate 50 may be provided secured to the second rigid plate 14. The elastic band 16 may be retained between the second rigid plate 14 and the outer rigid plate 50. As shown in FIGS. 27-28, the second rigid plate 14 may be provided with a slot 52 on the back 53, opposite the chamber 18, formed to have the elastic band 16 seat therewithin. Upper and lower edges 54 of the slot 52 may be off-set and chamfered or rounded in the same manner as the upper and lower edges 46 of the slot 44 to minimize wear of the elastic band 16. The clip 32 may be secured to the outer rigid plate 50.

With the described arrangement, portions of the elastic band 16 may be sandwiched between the first rigid plate 12 and the intermediate rigid plate 40, and, separately, between the second rigid plate 14 and the outer rigid plate 50, with portions 16*b* of the elastic band 16 spanning across the chamber 18, particularly across upper and lower portions thereof. This arrangement allows for retention of the elastic band 16, yet also allows for contracting and stretching of the elastic band 16 across the chamber 18 in response to insertion or removal of cards into, or from, the chamber 18.

With the elastic band 16 having the protruding pocket 16*a*, as shown in FIGS. 22-24, a secondary slot 44*a* may be formed on the inner face 42 of the intermediate rigid plate 40 extending transversely from the slot 44, as shown in FIG. 25. Side edge 45 of the secondary slot 44*a* may be offset from side edge 47 of the intermediate rigid plate 40 to provide clearance for the portion of the elastic band 16 defining the protruding pocket 16*a*. In addition, as shown in FIG. 27, a secondary slot 52*a* may be formed on the back 53 of the second rigid plate 14 extending transversely from the slot 52. Side edge 51 of the secondary slot 52*a* may be offset from side edge 55 of the second rigid plate 14 to provide clearance for the portion of the elastic band 16 defining the protruding pocket 16*a*. The secondary slots 44*a*, 52*a*, are configured to allow the portions of the elastic band 16, which define the protruding pocket 16*a*, to seat therein. In this manner, the protruding pocket 16*a* may have portions sandwiched between the first rigid plate 12 and the intermediate rigid plate 40, and, separately, between the second rigid plate 14 and the outer rigid plate 50, with a portion 16*c* of the protruding pocket 16*a* spanning across the chamber 18.

Figure 29:
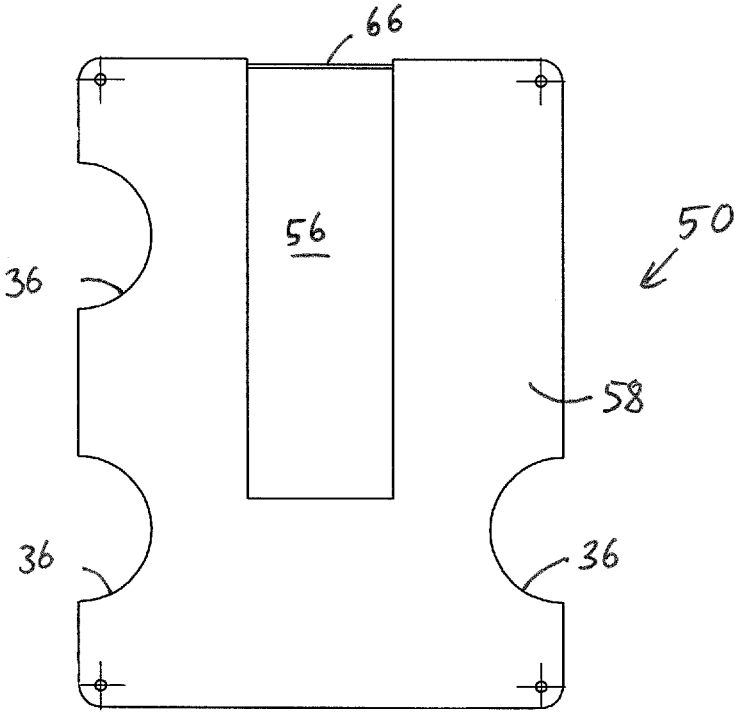
FIGS. 29-30 show an outer rigid plate useable with the wallet badge holder shown in FIGS. 11-12; and, FIGS. 31-33 show a clip useable with the wallet badge holder shown in FIGS. 11-12.
Figure 30:
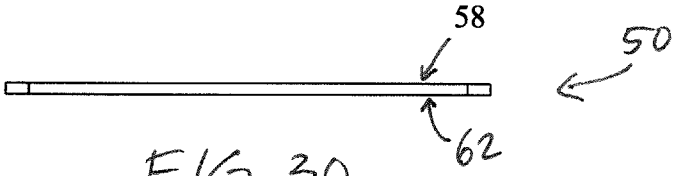
Figure 33:
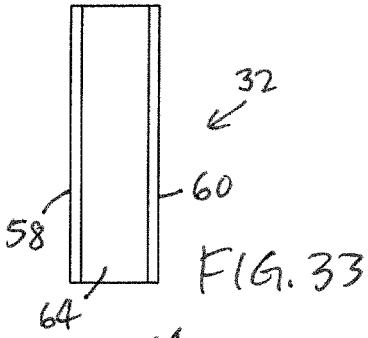
Figure 31:
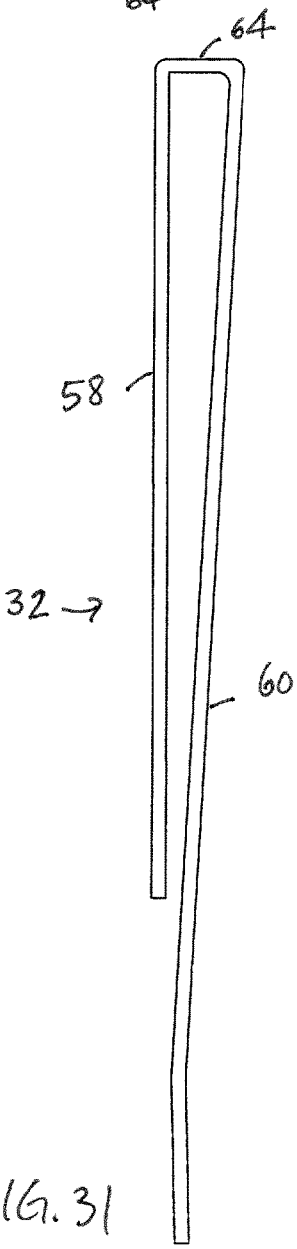
Figure 32:
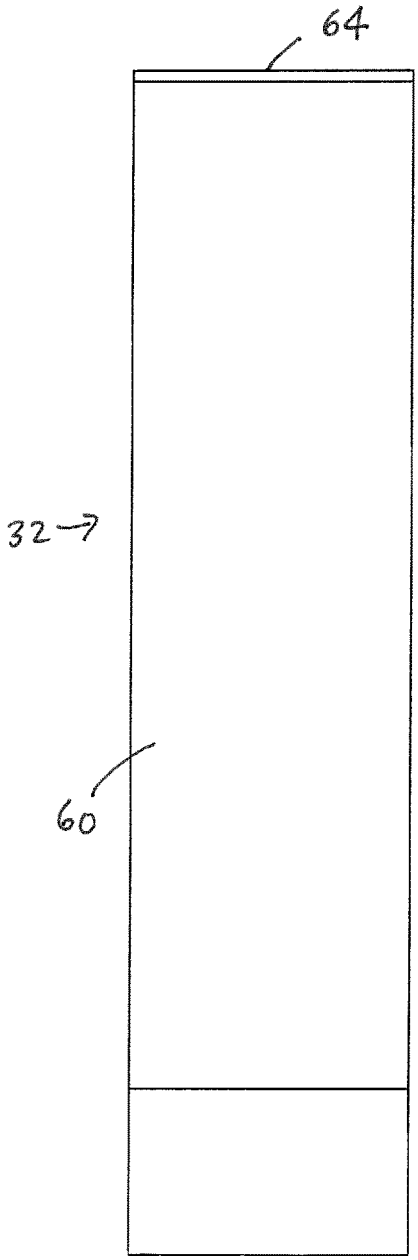

The outer rigid plate 50 may include mounting slot 56 formed on internal face 58, as shown in FIGS. 29-30, which faces the second rigid plate 14. The mounting slot 56 may be sized to accommodate rear plate 58 of the clip 32. The clip 32 may be mounted to the outer rigid plate 50 with bent portion 60 of the clip 32 located exteriorly of external face 62 of the outer rigid plate 50. The bent portion 60 may be internally biased about top edge 64 to provide a pressing force for the bent portion 60 towards the external face 62. The pressing force acts as a retentive force with the external face 62 to retain therebetween cash, a user's belt, and so forth. Upper edge 66 of the mounting slot 56 may be offset to accommodate the top edge 64 of the clip 32.

The finger cut-outs 36 may be provided on the second rigid plate 14 and/or the outer rigid plate 50, including being above and/or below the secondary slots 44*a*, 52*a*.

The first and second rigid plates 12, 14 and/or the cover 24 may be formed to be bullet-proof.

A badge and credit card holder are provided herein. The wallet badge holder may provide a clip to be used to hold money or to attach to a belt. The slim design will make it very comfortable to carry on a belt or in a pocket. The wallet badge holder can be manufactured from multiple materials such as: aluminum, carbon fiber, polycarbonate, titanium or zinc. The cover over the badge may be held by spring hinges. The cover may be able to open and close utilizing spring hinges and magnets. The cover may be removable to fully expose the badge. The card holder section, i.e., chamber, may be compressed by elastic band material. Cards may be protected by RFID paneling.

What is claimed is:

1. A wallet badge holder comprising:

a first rigid plate having a recess, formed therein shaped to accommodate a badge, and opposing first and second faces, wherein the recess is open in the first face, wherein the first and second faces extend longitudinally between spaced apart first and second edges, the recess being located in the first face between the first and second edges;

a second rigid plate elastically displaceable relative to the first rigid plate to define a reversibly expandable and compressible chamber for receiving identification cards and credit cards;

an intermediate rigid plate secured to the first rigid plate, the intermediate rigid plate facing the second face of the first rigid plate;

at least one elastic band passing between the first rigid plate and the intermediate rigid plate to extend between, and beyond, the first and second edges, and the at least one elastic band being also secured to the second rigid plate, wherein the chamber is defined between the intermediate plate and the second rigid plate; and, a cover removably mountable to the first rigid plate to selectively cover the recess, wherein the cover includes first and second cover plates, the second cover plate facing the recess with the cover mounted to the first rigid plate, a gap being formed between the first and second cover plates, wherein the second cover plate includes a transparent window.

2. A wallet badge holder as in claim 1, wherein the cover is removably mountable to the first rigid plate by magnetic connection.

3. A wallet badge holder as in claim 1, wherein the recess is formed to accommodate the badge fully recessed within the first rigid plate with no portion of the badge protruding from the first face of the first rigid plate.

* * * * *